US006505587B1

(12) United States Patent
Scheidt

(10) Patent No.: US 6,505,587 B1
(45) Date of Patent: Jan. 14, 2003

(54) SYSTEM FOR THE ROTATION OF A CAMSHAFT RELATIVE TO A CRANKSHAFT OF AN INTERNAL COMBUSTION ENGINE

(75) Inventor: Martin Scheidt, Adelsdorf (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/116,333

(22) Filed: Apr. 4, 2002

(30) Foreign Application Priority Data

Apr. 4, 2001 (DE) ..... 101 16 707

(51) Int. Cl.[7] ..... F01L 1/344
(52) U.S. Cl. ..... 123/90.17; 123/90.31
(58) Field of Search ..... 123/90.15, 90.17, 123/90.31, 90.6; 74/568 R; 464/1, 2, 160

(56) References Cited

U.S. PATENT DOCUMENTS

| | | | | |
|---|---|---|---|---|
| 5,673,659 A | * | 10/1997 | Regueiro | 123/90.17 |
| 5,979,382 A | * | 11/1999 | Heer | 123/90.17 |
| 6,202,611 B1 | * | 3/2001 | Regueiro | 123/90.17 |
| 6,457,446 B1 | * | 10/2002 | Willmot | 123/90.17 |

FOREIGN PATENT DOCUMENTS

| | | | |
|---|---|---|---|
| DE | 3607256 | | 9/1987 |
| DE | 19746529 | | 4/1999 |
| DE | 19807315 | * | 8/1999 |

* cited by examiner

*Primary Examiner*—Weilun Lo
(74) *Attorney, Agent, or Firm*—Volpe and Koenig, P.C.

(57) ABSTRACT

A system for the rotation of a camshaft relative to a crankshaft of an internal combustion engine, which includes a drive pulley connected to the crankshaft of the engine through a chain, belt, or sprocket drive, and includes an electric motor that transfers torque to the camshaft of the engine. The electric motor is flanged directly to one end of the and is a primary drive unit of the camshaft as well as a servomechanism to adjust and maintain a controlled camshaft angular shift, whereas the drive pulley is fastened to and moves about the other end of the camshaft within a defined range of rotation and is provided as a forced synchronization instrument for the electric motor within the range of rotation, as well as being a secondary drive unit of the camshaft. Further, the electric motor (7) is connected to an RPM controller (10) that synchronizes and modifies the RPM of the electric motor (7) relative to the RPM of the drive pulley (4).

5 Claims, 2 Drawing Sheets

SYSTEM FOR THE ROTATION OF A CAMSHAFT RELATIVE TO A CRANKSHAFT OF AN INTERNAL COMBUSTION ENGINE

BACKGROUND

This invention pertains to a system for the rotation of a camshaft relative to a crankshaft of an internal combustion engine, in which a drive pulley is connected to the crankshaft of the engine through a chain, belt or sprocket drive, and an electric motor transfers torque to the camshaft of the engine.

In addition to known hydraulic systems that rotate a camshaft relative to a crankshaft of an internal combustion engine, there are also a number of known systems that use electric motors to accomplish this relative rotation of the camshaft. Shifting the angular position of the camshaft electrically has proven to be advantageous compared to hydraulic angular shifting in that the necessary electrical energy is already available prior to the internal combustion engine being started, and is not subject to the limitations of a hydraulic system's manufacture. What is especially disadvantageous in hydraulic systems is the feed characteristics of the hydraulic pressure medium, which is dependent on RPM and temperature, which only allows the camshaft to shift its angle relatively slowly at low engine RPM's and/or at low pressure medium temperatures.

A system for the rotation of a camshaft relative to a crankshaft of an internal combustion engine that defines this class of electrical shifting of angular position is known from DE 198 07 315 A1, for example. This system is formed essentially of a drive pulley that is connected to the crankshaft of the internal combustion engine through a chain drive, and an electrical servomotor that transfers torque to the camshaft of the internal combustion engine. In this system, a reducing sprocket gear is located between the servomotor and the camshaft. This sprocket gear consists in turn of an external rotor with inner teeth fastened to the camshaft, and an inner rotor with external teeth fastened to the drive pulley. The servomotor, the drive pulley and the inner rotor of the sprocket gear form a single assembly that drives the camshaft through the external rotor of the sprocket gear. The relative rotation of the camshaft with respect to the crankshaft is then accomplished through an angular rotation superimposed on the internal rotor of the sprocket gear by the servomotor. This angular rotation acts on the camshaft by means of the external rotor of the sprocket gear.

However, this very advantageous solution has the disadvantage, as do other known solutions that use a planet gear, eccentric gear or helical gear or the like installed between an electric motor and the camshaft to produce the relative rotation of the camshaft, in that the reduction gears used to prevent unwanted noises that result from the alternating moments of the camshaft have to be either very precisely designed or provided with additional play-compensating elements. Reduction gears are also not a cost-effective alternative to hydraulic shifting systems considering the concomitant increase in costs to manufacture this kind of electrical shifting system. Moreover, to achieve as much frictional retention as possible, these types of reduction gears are usually designed with high reduction ratios, which have the disadvantage of magnifying the reduction in the backlash of the gears as well, thus resulting in an imprecise angular shift of the camshaft.

SUMMARY

Therefore, the object of this invention is to design a system to rotate a camshaft relative to a camshaft of an internal combustion engine that has the advantages of the designs found in electrical shifting systems and that at the same time avoids the disadvantages of a reduction gear installed between an electric motor and the camshaft. This design is more cost-effective and more functionally accurate.

According to the invention, this object is met with a system in which the electric motor is flanged to one end of the camshaft directly or through an intermediate drive, and is designed as a primary drive unit of the camshaft as well as a servomechanism to adjust and maintain a controlled camshaft angular shift. The drive pulley is fastened to and moves about the other end of the camshaft, within a defined range of rotation, and is provided as a forced synchronizing instrument of the electric motor within the range of rotation as well as a secondary drive unit of the camshaft. In this manner, the electric motor is connected to an RPM controller as well, which synchronizes and changes the RPM of the electric motor relative to the RPM of the drive pulley to adjust and maintain a controlled camshaft angular shift.

In an advantageous embodiment of the system designed according to the invention, the wheel hub of the drive pulley fastened to the other end of the camshaft is supported in and rotates about an axial support, the sides of which are formed on one side by a shoulder created by a reduction in diameter in the camshaft and on the other side by the circular edge of an annular disk that is fixed to the other end of the camshaft. This annular disk is preferably bolted by an axial fastening screw centrally at the end of the camshaft, and is preferably designed with a bent edge so that it fits over the end of the camshaft in the shape of a cap. Its bent edge forms the side of the axial support for the drive pulley. However, it is also possible to design the annular disk without such a bent edge and/or to fasten it in another suitable manner to the end of the camshaft. Between the annular disk and the shoulder in the camshaft mentioned, the wheel hub of the drive pulley is then supported on and rotates about the section of the camshaft with the reduced diameter. It is even more advantageous, in the case of a drive pulley located in a belt drive, to place, in addition, a support bushing between its wheel hub and the camshaft to provide a dry bearing.

Another important feature of this annular disk fixed to the camshaft, which axially fixes the drive pulley of the system according to the invention, is that it also has a radial follower bracket that sits in a chamber in the rim of the drive pulley that has the shape of an annular segment. The sum of the angles between the side walls of this chamber, which are designed as impact surfaces, and the lateral edges of the follower bracket is equal to the defined range of rotation of the drive pulley, i.e. the maximum angular shift of the camshaft. Only allowed timing positions of the gas exchange valves in the internal combustion engine, which are actuated by the camshaft, can occur within this range. The chamber for the follower bracket can be designed as a recess in the rim of the drive pulley produced by stamping, forming or the like, or as a penetration in the same produced through cutting or other means.

Furthermore, the system designed according to the invention is characterized in that the base position of the camshaft, necessary mainly to start the internal combustion engine, is determined at the respective impact position of the follower bracket of the annular disk at one of the two side walls of the chamber in the drive pulley, depending on whether the camshaft is designed as an inlet or an exhaust camshaft. This base position is fixed by a holding torque resulting from a braking or an accelerating RPM control action on the electric motor relative to the drive pulley, said holding torque also acting on the follower bracket. In the case of an inlet camshaft, this base position usually corresponds to a "late" timing position of the gas exchange valves that can be fixed using a braking RPM control action on the electric motor relative to the drive pulley when the inlet camshaft is rotating clockwise as seen from the drive pulley side. This RPM control action pushes the follower bracket on the inlet camshaft against the side wall of the chamber in the drive pulley opposite the direction of rotation of the drive pulley. The base position of an exhaust camshaft, on the other hand, usually corresponds to an "early" timing position of the gas exchange valves that can be fixed using an accelerating RPM control action on the electric motor relative to the drive pulley when the exhaust camshaft is likewise rotating clockwise as seen from the drive pulley side. This RPM control action causes the follower bracket on the inlet camshaft to push against the side wall of the chamber in the drive pulley in the direction of rotation of the drive pulley. In this way, chatter between the follower bracket on the camshaft and the side walls of the chamber in the drive pulley, caused by the alternating moments of the camshaft, can be effectively prevented, especially when the engine is started, but also while the camshaft is shifted during operation of the engine.

Finally, in a useful extension of the system designed according to the invention, it is proposed to install an electronic controller ahead of the electric motor's RPM controller that can regulate the electric motor's RPM controller through the evaluation of data from an instrument to detect the position of the crankshaft and from an instrument to detect the position of the camshaft, as well as other operating parameters of the internal combustion engine. The RPM controller can be designed as a known potentiometer or the like, which imposes different RPM's on the electric motor based on its different currents. Likewise, the instruments to detect the positions of the camshaft and the crankshaft are preferred to be designed as known induction or photo sensors that cooperate with triggering disks located on the camshaft and crankshaft accordingly. The other detected operating parameters in the controller are the motor load, motor temperature and motor RPM, which together with the positions of the camshaft and crankshaft are evaluated and converted into an appropriate control signal for the electric motor's RPM controller. By constantly detecting and evaluating this data in the controller, it is possible to react to all operating conditions of the engine by appropriately changing the RPM of the electric motor and thus changing the angular position of the camshaft with respect to the crankshaft. Basically, the adjustment of a controlled camshaft angular shift is accomplished based on the base position of the camshaft in that first the RPM of the camshaft is synchronized to the RPM of the drive pulley so as to introduce the angular shift of the camshaft starting from this synchronized RPM by braking or accelerating the electric motor. After attaining the shift angle of the camshaft, the RPM of the electric motor is again synchronized with respect to the RPM of the drive pulley and the next angular shift of the camshaft is made from that point, with the drive pulley "idling" at all positions of the follower bracket other than its impact positions in the chamber of the drive pulley.

The system designed according to the invention to rotate a camshaft relative to a crankshaft of an internal combustion engine thus has the advantage, when compared to systems known from the state of the technology operated by electric motors, in that there is no longer a need for a reduction gear installed between the electric motor and the camshaft since the camshaft is driven directly by an electric motor to shift the angular position of the camshaft. Since this also eliminates all means necessary to compensate for play and for retention within these gears, and since the drive pulley of the camshaft can also be designed as a conventional chain, belt, or sprocket pulley, the system according to the invention has, above all, considerable cost advantages in comparison with the known electrical shifting systems and at the same time also represents a valuable alternative to the known hydraulic shifting systems. Moreover, direct drive of the camshaft by the electric motor at all times guarantees a precise angular positioning of the camshaft with respect to the crankshaft with no play, wherein by forced synchronization of the camshaft mechanically by means of the follower bracket on the camshaft and the chamber in the drive pulley, it is also ensured that only allowed timing positions of the gas exchange valves, which are actuated by the camshaft, can occur during disruptions, during shutoff and startup of the engine.

BRIEF DESCRIPTION OF THE DRAWINGS

This invention is explained in more detail below with on the basis of a preferred embodiment and is shown schematically in the associated drawing. In the drawings.

DETAILED DESCRIPTION OF THE PREFERRED EMBODIMENT

Figure 1:
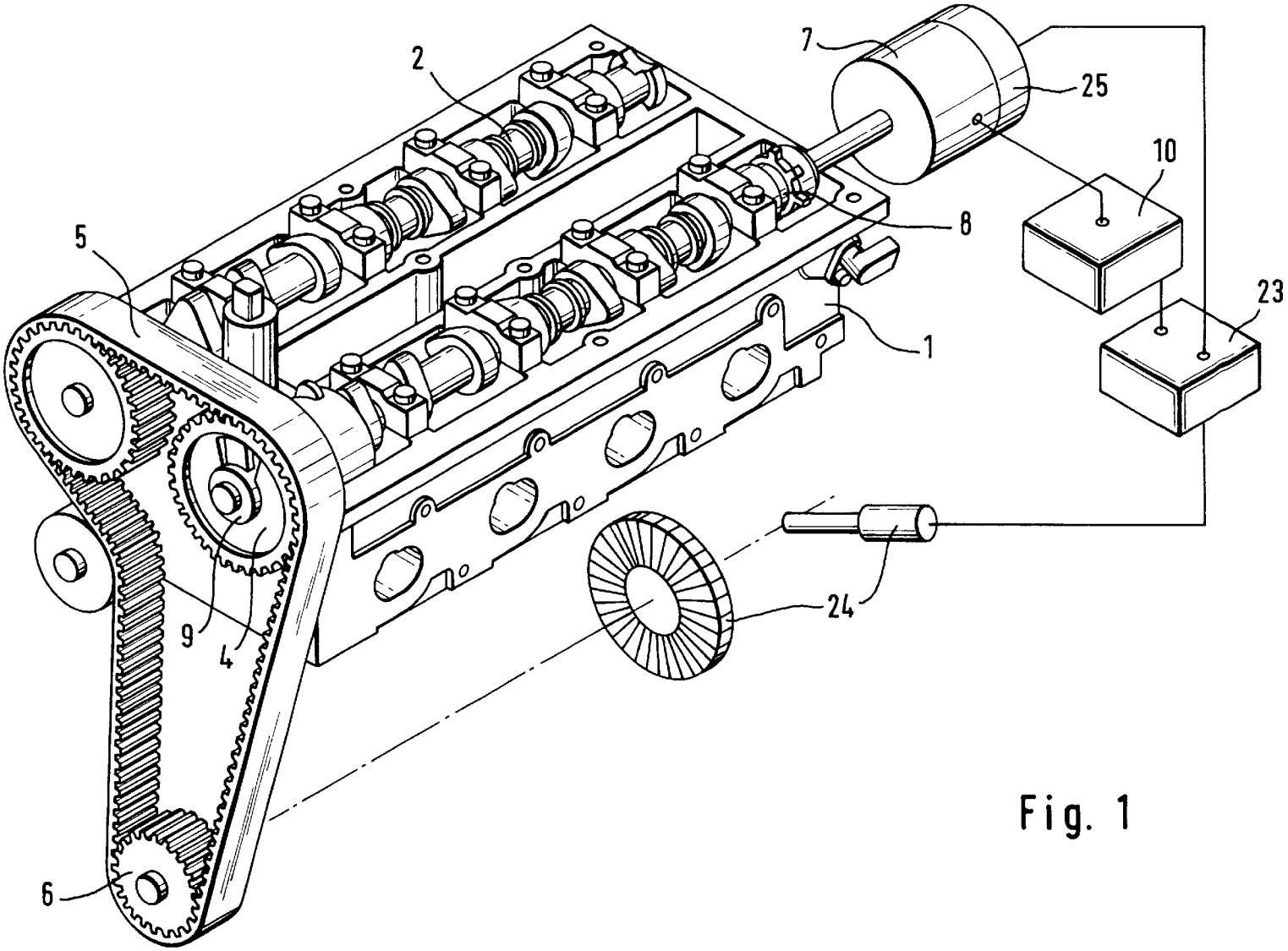
FIG. 1 is a schematic representation of a cylinder head of an internal combustion engine designed with two overhead camshafts with the system according to the invention attached to one of the two camshafts.

Shown in FIG. 1 is the cylinder head 1 of an internal combustion engine with two overhead camshafts 2, 3. Of these, camshaft 3, which is designated as an exhaust camshaft, includes a system to rotate camshaft 3 relative to the crankshaft of the engine (not shon). This system includes a drive pulley 4, which is connected to the crankshaft belt pulley 6 of the engine through belt drive 5, and an electric motor 7 that transfers torque to camshaft 3 of the engine.

Moreover, it can be seen in FIG. 1 that the electric motor 7 is directly attached to the end 8 of the camshaft 3 according to the invention, and thus forms the primary drive unit of the camshaft 3 as well as the servomechanism to adjust and maintain a controlled camshaft angular shift. The drive pulley 4 is fastened to and moves about the other end 9 of the camshaft 3 within a defined range of rotation. Within this range of rotation, it is designed as a forced synchronization instrument of the electric motor 7 as well as a secondary drive unit of the camshaft 3. The electric motor 7 is also connected to an RPM controller 10 that synchronizes the RPM of the electric motor 7 to maintain a controlled camshaft angular shift and modifies it to adjust a new camshaft angular shift.

Figure 3:
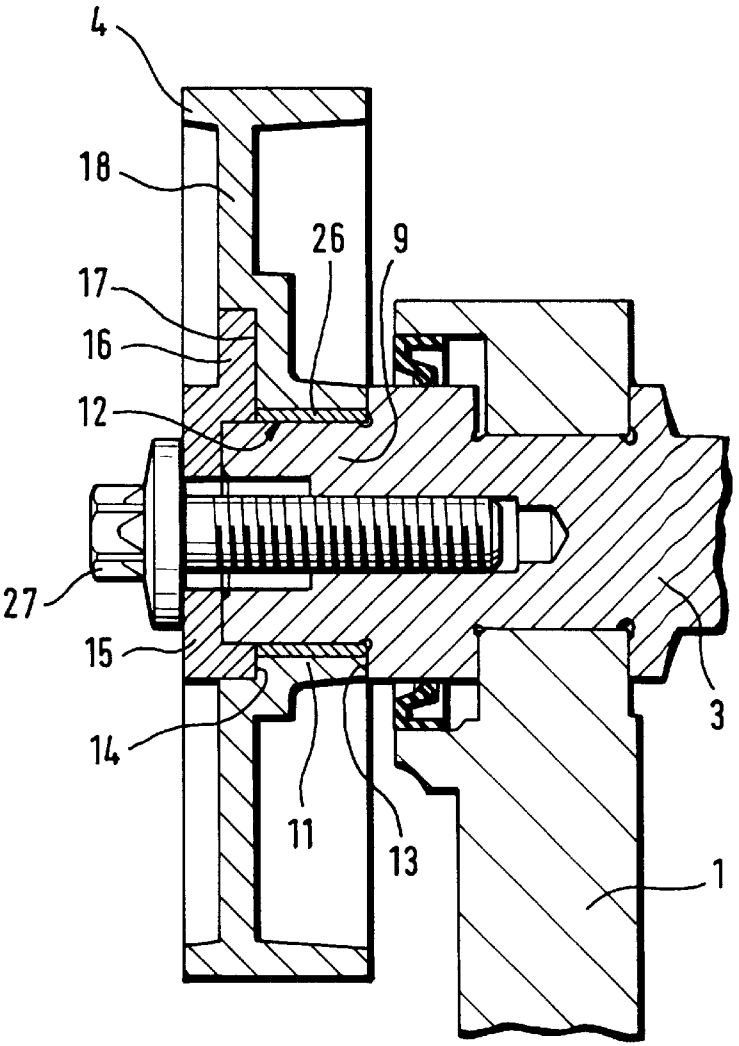
FIG. 3 is a cross section through the drive pulley mounted to the camshaft of the system according to the invention.
Figure 2:
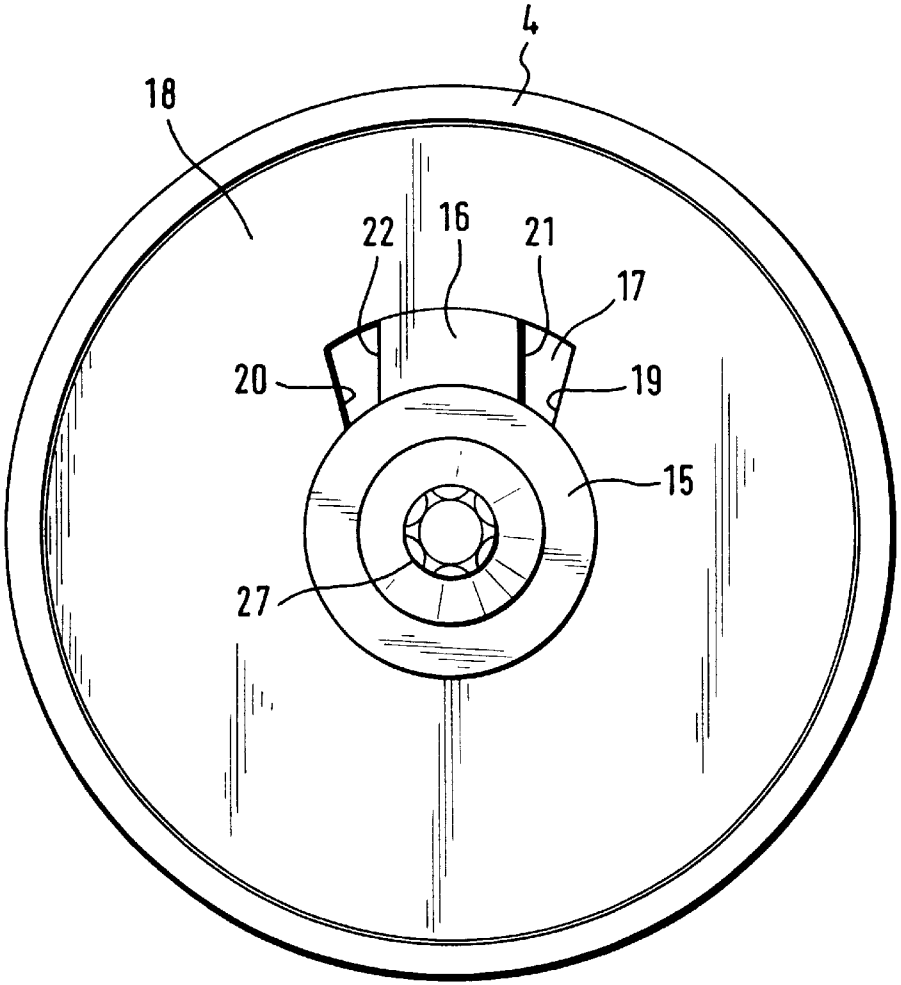
FIG. 2 is an front view of the drive pulley of a system according to the invention.

FIGS. 2 and 3 show, moreover, that the wheel hub 11 of the drive pulley 4 fastened to the other end 9 of the camshaft 3 turns about an axial support 12 to realize the range of rotation. The sides of the axial support are formed on one side by a shoulder 13 created by a reduction in diameter in the camshaft 3 and on the other side by the circular edge 14 of an annular disk 15 that is non-rotably fixed to the end of the camshaft 3. In FIG. 3, it can be clearly seen that the annular disk 15 is bolted to the other end 9 of the camshaft 3 with an axial fastening screw 27, and has a bent edge 14 in this design that fits over the other end 9 of the camshaft 3 like a cap, the end of which constitutes one of the support sides of the axial support 12 for the drive pulley 4. To improve the radial support of the drive pulley 4, in this case designed as a belt pulley, an additional support bushing 26, also indicated in FIG. 3, is placed between its wheel hub 11 and the camshaft 3. This support bushing guarantees a dry bearing for the support of the drive pulley 4, which must be kept free of lubricants where belt drives are used.

Furthermore, FIGS. 2 and 3 show that the annular disk 15 also has a radial follower bracket 16 on the camshaft 3 that sits in a chamber 17 in the rim 18 of the drive pulley 4 that is in the shape of an annular segment. This chamber 17 is designed as a local recess in the rim 18 of the drive pulley 4 that had been formed into the drive pulley 4 when it was produced, in this case from sintered metal. The size of the segment of the chamber 17 and the width of the follower bracket 16 are selected such that the sum of the angles seen in FIG. 2 between the side walls 19, 20 of the chamber 17 designed as impact surfaces for the follower bracket 16 and the lateral edges 21, 22 of the follower bracket 16 is equal to the defined range of rotation of the drive pulley 4, i.e. is equal to the maximum angular shift of the camshaft 3.

Finally, with the help of the representation according to FIG. 2, it can be seen that the base position of camshaft 3, which is designed as an exhaust camshaft, which is needed mainly to start the internal combustion engine, is determined by the position at which the follower bracket 16 of the annular disk 15 impacts the side wall 19 of the chamber 17 in the drive pulley 4. This impact position of the follower bracket 16 corresponds to an "early" timing position of the gas exchange valves of the internal combustion engine that are actuated by the camshaft 3. In this base position, the camshaft 3 is fixed by a holding torque that acts on the follower bracket 16 in addition by means of an accelerated RPM control action on the electric motor 7 relative to the drive pulley 4 so as to prevent the follower bracket 16 from chattering in the chamber 17 as a result of alternating moments on the camshaft 3 when the engine is started. In this way, the control of the RPM of the electric motor needed to accomplish this is done, as is the control of the RPM to adjust and maintain a controlled camshaft angular shift, by a electronic controller 23 installed ahead of the RPM controller 10 of the electric motor 7, indicated in FIG. 1 only. As shown in FIG. 1 schematically as well, this electronic controller in turn is connected to an instrument 24 to detect the position of the crankshaft and to an instrument 25 to detect the position of the camshaft 3 as well as to other measurement points to detect various operating parameters of the engine, which are not shown. The data collected by the instruments 24, 25 and the other measurement points are evaluated by this electronic controller 23 and are converted to a signal with which the RPM controller 10 of the electric motor 7 can be controlled such that the camshaft 3 has an optimum angular position with respect to the crankshaft in every operating state of the engine.

LIST OF ELEMENTS

1 Cylinder head
2 Camshaft
3 Camshaft
4 Drive Pulley
5 Belt Drive
6 Crankshaft Belt Pulley
7 Electric Motor
8 One End of 3
9 The Other End of 3
10 RPM Controller
11 Wheel Hub
12 Axial Support
13 Shoulder
14 Edge
15 Annular Sisk
16 Follower Bracket
17 Chamber
18 Rim
19 Side Wall
20 Side Wall
21 Lateral Edge
22 Lateral Edge
23 Controller
24 Instrument
25 Instrument
26 Support Bushing
27 Fastening Screw

What is claimed is:

1. A system to rotate a cam relative to a crankshaft of an internal combustion engine, comprising a drive pulley (4) that is connected to the crankshaft of the engine through a chain, belt or sprocket drive (5), an electric motor (7) that transfers torque to the camshaft (3) of the engine, the electric motor (7) is attached to one end (8) of the camshaft (3) directly or through an intermediate drive mechanism, and acts as a primary drive unit of the camshaft (3) and as a servomechanism to adjust and maintain a controlled camshaft angular shift, the drive pulley (4) is fastened to and moves about an other end (9) of the camshaft (3) within a defined range of rotation and acts as a forced synchronization instrument for the electric motor (7) within the range of rotation as well as a secondary drive unit for the camshaft (3), wherein the electric motor (7) is connected to an RPM controller (10) with which an RPM of the electric motor (7) is synchronized and changed with respect to an RPM of the drive pulley (4) to adjust and maintain a controlled camshaft angular shift.

2. A system according to claim 1, wherein a wheel hub (11) of the drive pulley (4) fastened to the other end (9) of the camshaft (3) rotates about an axial support (12) having sides formed on one side by a shoulder (13) created by a reduction in diameter in the camshaft (3) and on the other side by a circular edge (14) of an annular disk (15) fixed to the end of the camshaft (3).

3. A system according to claim 2, wherein the annular disk (15) also has a radial follower bracket (16) that sits in a chamber (17) in a rim (18) of the drive pulley (4) that is shaped as an annular segment, and a sum of angles between side walls (19, 20) of the chamber (17), which act as impact surfaces, and lateral edges (21, 22) of the follower bracket (16) equals a maximum angular shift in the defined range of rotation of the drive pulley (4).

4. A system according to claim 3, wherein a base position of the camshaft (3) to start the internal combustion engine is determined at a respective impact position of the follower bracket (16) of the annular disk (15) at one of the two side walls (19, 20) of the chamber (17) in the drive pulley (4), depending on whether the camshaft is designed as an inlet or an exhaust camshaft, and the base position is fixed by a holding torque also acting on the follower bracket (16) resulting from a braking or an accelerating RPM control action on the electric motor (7) relative to the drive pulley (4).

5. A system according to claim 1, wherein the RPM controller (10) of the electric motor (7) is connected to an electronic controller (23) that controls the RPM controller (10) of the electric motor (7), by evaluating data from an instrument (24) to detect a position of the crankshaft and an instrument (25) to detect a position of the camshaft (3) as well as other operating parameters of the internal combustion engine.

* * * * *